US008997855B2

(12) United States Patent
O'Malley et al.

(10) Patent No.: US 8,997,855 B2
(45) Date of Patent: Apr. 7, 2015

(54) REDUCTION OF EXPANSION FORCE VIA RESONANT VIBRATION OF A SWAGE

(75) Inventors: Edward J. O'Malley, Houston, TX (US); Steven N. Bailey, Corpus Christi, TX (US)

(73) Assignee: Baker Hughes Incorporated, Houston, TX (US)

( * ) Notice: Subject to any disclaimer, the term of this patent is extended or adjusted under 35 U.S.C. 154(b) by 385 days.

(21) Appl. No.: 11/862,801

(22) Filed: Sep. 27, 2007

(65) Prior Publication Data

US 2008/0073076 A1 Mar. 27, 2008

Related U.S. Application Data

(60) Provisional application No. 60/847,565, filed on Sep. 27, 2006.

(51) Int. Cl.
*E21B 28/00* (2006.01)
*E21B 29/08* (2006.01)
*E21B 43/10* (2006.01)

(52) U.S. Cl.
CPC ..... *E21B 43/105* (2013.01)

(58) Field of Classification Search
CPC ..... E21B 43/105
USPC ..... 166/248, 249, 67, 177.1, 177.2, 177.6, 166/55, 55.1; 175/55
See application file for complete search history.

(56) References Cited

U.S. PATENT DOCUMENTS 4,869,097 A * 9/1989 Tittmann et al. ..... 73/52
6,009,948 A * 1/2000 Flanders et al. ..... 166/301
6,045,026 A 4/2000 Hembree et al.
6,296,171 B1 10/2001 Hembree et al.
6,419,143 B2 7/2002 Hembree et al.
6,427,899 B2 8/2002 Hembree et al.
6,464,014 B1 * 10/2002 Bernat ..... 166/384
6,489,707 B1 * 12/2002 Guerrero ..... 310/334
6,619,532 B2 9/2003 Hembree et al.
6,691,777 B2 2/2004 Murray et al.
6,702,195 B2 3/2004 Traboid
6,851,597 B2 2/2005 Hembree et al.
7,264,055 B2 * 9/2007 Mody et al. ..... 166/301
7,377,326 B2 * 5/2008 Shuster et al. ..... 166/384
7,775,290 B2 * 8/2010 Brisco et al. ..... 166/384
7,896,019 B2 * 3/2011 Bettin et al. ..... 137/13
2002/0148606 A1 * 10/2002 Zheng et al. ..... 166/249
2004/0011136 A1 * 1/2004 Berman ..... 73/662
2004/0251035 A1 * 12/2004 Simpson et al. ..... 166/384
2005/0230101 A1 * 10/2005 Zheng et al. ..... 166/177.6
2006/0108123 A1 * 5/2006 De Lucia et al. ..... 166/380
2011/0094732 A1 * 4/2011 Lehman et al. ..... 166/249

* cited by examiner

*Primary Examiner* — James G Sayre
(74) *Attorney, Agent, or Firm* — Mossman, Kumar & Tyler, PC

(57) ABSTRACT

An apparatus includes a body shaped to deform a wellbore tool in a predetermined manner. A vibration device applies a vibration to the body to reduce a frictional force caused when the body deforms the wellbore tool. In one arrangement, the vibration devices imparts a resonant wave motion to a swaging apparatus that is being pushed through a passage of a wellbore tubular. A swaging body vibrates at a resonant frequency along the long axis of the wellbore tubular and/or normal to long axis of the wellbore tubular. The relative motion between the swaging body and the tubular member reduces the force required to expand the wellbore tubular. Optionally, a controller operatively connected to the vibration device adjusts the operation of the vibration device in response to the sensor measurements of the vibrations in the swage body.

17 Claims, 2 Drawing Sheets

REDUCTION OF EXPANSION FORCE VIA RESONANT VIBRATION OF A SWAGE

CROSS-REFERENCE TO RELATED APPLICATIONS

This application which claims priority from U.S. Provisional Application No. 60/847,565 filed Sep. 27, 2006.

BACKGROUND OF THE INVENTION

1. Field of the Invention

The present invention relates to oilfield downhole operations. More particularly, the present invention relates to devices and related methods for expanding one or more sections of a wellbore tubular such as a tubular using a resonant swaging mechanism.

2. Description of the Related Art

As is well known to those of skill in the art, expandable tubulars have been known to the oilfield art. Many methods have been used to expand tubulars in the borehole. One conventional prior art method employs a swaging device. Swaging devices generally comprise a conical or frustoconical hardened member having an outside diameter as large as possible while being passable through the wellbore casing or the open hole. This swage is urged to travel through a tubular whereby the tubular or junction is reformed into an operational position.

One of the problems encountered in swaging any tubular in a wellbore is the high frictional resistance that results from the contact between the swage and the contacted surface. Often, the cross-sectional shape of the pipe is elliptical and not round. Swaging such a cross-sectional shape generates extremely high contact forces, which can cause galling and tearing of either or both of the swage and the pipe, which can in turn increase the force required to push the swage through the tubular.

A proposed solution of the above-described problem is described in U.S. Pat. No. 6,691,777, which teaches a self-lubricating swage. The described swage expands tubulars and includes a primary swaging tool supported on a mandrel. In one version, the mandrel has a lubricious capacity. In another version, the primary swaging tool is supported on a mandrel and a nose swage member is supported on an end of the mandrel. The nose swage member is fabricated of, is coated with or otherwise includes and applies a lubricious material that smears onto a surface coming into contact with the nose swage member. The smearing of the lubricious material is described as facilitating the sliding of the swaging member as it contacts the inner walls of the tubular.

While lubrication has in some aspects facilitated the swaging process, there remains a persistent need for devices and methods that more efficiently perform swaging operations. The present invention addresses these and other needs of the prior art.

SUMMARY OF THE INVENTION

In aspects, the present invention provides systems, devices, and methods for reducing an amount of force required to deform wellbore devices in downhole applications. In one embodiment, the present invention provides an apparatus that includes a body shaped and sized to deform a wellbore tool in a predetermined manner. This deformation can include a diametrical expansion of the wellbore tool. While the body engages and deforms the wellbore tool, a vibration device applies a vibration to the body to reduce a frictional force caused when the body deforms the wellbore tool. In one arrangement, the vibration devices operates as a resonating device that imparts a resonant wave motion to a swaging apparatus that is being pushed through a passage of a wellbore tubular. A swaging body of the swaging apparatus vibrates at a resonant frequency along the long axis of the wellbore tubular and/or normal to long axis of the wellbore tubular. The relative motion between the swaging body and the tubular member can reduce the force required complete the expansion of the wellbore tubular. In some arrangements, a sensor fixed to the body measures a vibration of the body. A controller operatively connected to the vibration device adjusts the operation of the vibration device in response to the sensor measurements. The vibration device includes transducers using a plurality of electrically activated elements, a hydraulic actuator, or a pneumatic actuator.

It should be understood that examples of the more important features of the invention have been summarized rather broadly in order that detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein.

DESCRIPTION OF THE PREFERRED EMBODIMENTS

Figure 1:
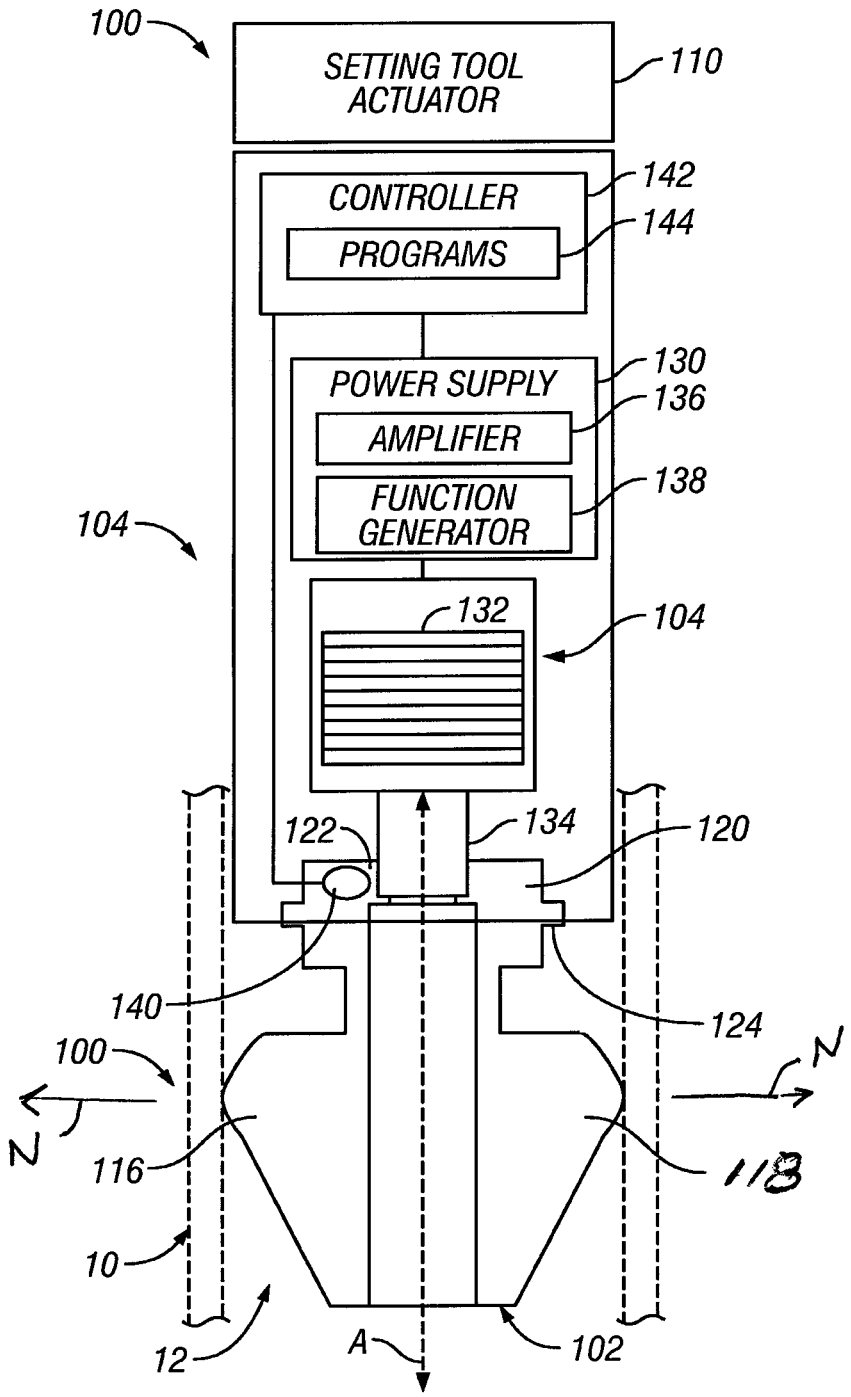
FIG. 1 schematically illustrates one embodiment of an expansion device made in accordance with the present invention.

The present invention relates to devices and methods for using vibrations to improve the efficiency of wellbore devices that encounter undesirable frictional forces during operation. In one aspect, the present invention relates to devices for expanding wellbore tubulars such as screens, packers, patches, liner hangers, liners, tubing, etc. Merely for convenience, the teachings of the present invention will be described in the context of a wellbore tubular such as liner or tubing. It should be understood, however, that the present invention is not limited to any particular wellbore application or tool. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein. Indeed, as will become apparent, the teachings of the present invention can be utilized for a variety of well tools and in all phases of well construction and production. Accordingly, the embodiments discussed below are merely illustrative of the applications of the present invention.

Referring initially to FIG. 1, there is schematically illustrated one embodiment of an expansion device 100 made in accordance with the present invention for expanding a section of a wellbore device 10. The expansion device 100 includes a swage body 102 and a vibration device 104. The vibration device 104 imparts a vibration to the swage body 102 while the swage body 102 is being pushed through a passage of a wellbore tubular 10 by a setting tool 110. The vibrations reduce the frictional forces between the engaging surfaces of the swage body and the wellbore tubular 10 and thereby reduce the amount of force the setting tool 110 must generate for this swaging action.

An exemplary swage body 102 includes a head 116 having an enlarged diameter portion 118 and a base 120. The enlarged diameter portion 118 is shaped to engage and plastically deform the selected wellbore tool tubular 10. In many embodiments, this engagement involves the head 116 being pushed or pulled through a bore or passage 12 through the wellbore tubular 10. Thus, the head 116 may be tubular or frustoconical in shape and formed of high strength metal that has a high modulus of compression such that it can force the wall of the selected wellbore tubular outward without being itself compressed. Such details of swage design are generally known in the art and will not be discussed in further detail. The base 120 of the swage body is formed to connect to the vibration device 104 via a suitable connection mechanism such as a threaded portion 122 and has an outer surface 124 configured to connect with the setting tool 110.

When energized, the setting tool 110 translates the swage body 102 axially through the wellbore tubular. The setting tool 110 can utilize a hydraulic, electromechanical or even a pyrotechnic arrangement to generate the necessary force needed to drive the swage body 102 through the wellbore tubular. In many instances, the setting tool 110 generates a substantially static force for moving the swage body 102. The designs of setting tools are known in the art and will not be discussed in further detail.

The vibration device 104 applies a vibration to the swage 102 while the setting tool applies the setting force to the swage 102. This vibration reduces the force required to expand the wellbore tubular. In one embodiment, the vibration device 104 utilizes an ultrasonic transducer device that vibrates the swage 102 at a resonant frequency. The vibrations reduce the friction between the mating surfaces of the swage 102 and the wellbore tubular and therefore reduce the magnitude of the driving force that must be generated by the setting device 126.

In one arrangement, the vibration device 104 includes a power supply 130, one or more transducer stacks 132 of piezoelectric elements, and coupling member 134. A control unit excites the transducer stack 132 using an applied current from the power supply 130. The coupling member 134 transfers the vibrations to the swage body 102. The expansion device 100 is a tuned system in that the characteristics of the applied current and construction of the swage body 102 are selected to induce a resonance of the swage body 102. Other suitable actuators can include magnetostrictive transducers, hydraulic or pneumatic oscillators, and even impulsive forces such as jars. It should be understood that in some embodiments, two or more resonators can be used to cooperatively generate the desired vibrations.

In embodiment utilizing electrically-activated transducers as shown, the vibration of the transducer will directly correspond to the resonant frequency of the swage. The power supply 130 can include an amplifier 136 supplying power to the transducer and a function generator 138 providing a driving signal. Some embodiments can also utilize a feedback mechanism to increase the efficiency of the expansion device 100. Such embodiments can include a sensor 140 such as one or more accelerometers that provide signals to a controller 142. The controller 142 may be a general purpose processor, such as a microprocessor, digital signal processor (DSP) or any other device that can process the required signals and data from the sensor 140. The controller can include programmed instructions 144 to determine frequency measurements and adjust the operation of the expansion device 100 if a change in the resonant properties of the expansion device 100 is detected.

In embodiments using a hydraulic or pneumatic oscillator (not shown), the operating frequency of the oscillator would be an appropriate fraction of the resonant frequency of the swage 102 so that harmonics from the oscillator would excite the resonance frequency in the swage. Impulsive blows to the swage 102 would have a similar affect as the oscillators described above. In the case of impulsive excitation of the swage, successive blows from a suitable source would strike the swage, effectively hammering it through the wellbore device while simultaneous exciting resonances in the swage. However, the vibration would "ring down" after each blow as opposed to having sustained amplitude. In the case of sustained vibration of the swage, it is desirable to excite the resonant swage prior to contact with the wellbore tubular.

The vibration device 104 can cause the swage 102 to vibrate along multiple axes such as along a long axis A of the wellbore tubular and normal to the long axis of the wellbore tubular. For vibrations normal to the long axis of the wellbore tubular (hereafter "radial" vibrations), the circumference of the swage body 102 expands and contracts as shown by arrows N; i.e., the entire outer edge of the swage moves away from and towards a centerline of the swage 102 when the vibration device 104 applies the vibration. It is believed that the application of radial vibrations reduces the force required to expand the tubular 10 through a process called superposition. In superposition, the dynamic component or force generated by the vibrating swage body 102 is added to the static force component applied by the setting tool 110. The magnitude of the dynamic component of force is the product of the amplitude of the displacement, the square of the operation frequency, and the "moving mass" of the swage body 102. For example, if a radially vibrating swage were operating at 0.0001 inches of displacement at 20 kHz, with an estimated moving mass of 10 pounds, the dynamic force generated is approximately 22500 pounds. For vibrations along the long axis of the wellbore tubular (hereafter "axial" vibrations), expansion force reduction is expected due the constant relative motion of the active surface of swage and the surface of the wellbore tubular. It is believed that a constant relative motion of contacting surfaces tends to push effective friction coefficients to a relative minimum.

While the vibration device 104 has been described as distinct from the setting device 110, it should be understood that the setting device 110 itself can be operated to induce the necessary vibrations. It should also be understood that the swage 102 is merely representative of the types of wellbore tool that can benefit from the teachings of the present invention. Numerous other wellbore devices apply a static force during operation. Exemplary devices include liner hangers, thrusters, and fishing tools. Application of vibrations utilizing the teachings of the present invention can add a dynamic component or force generated by these devices and thereby improve the overall operation of these devices. For instance, conventional fishing tools can be modified using the teachings of the present invention to generate a more effective jarring effect for dislodging stuck wellbore tools.

Figure 2:
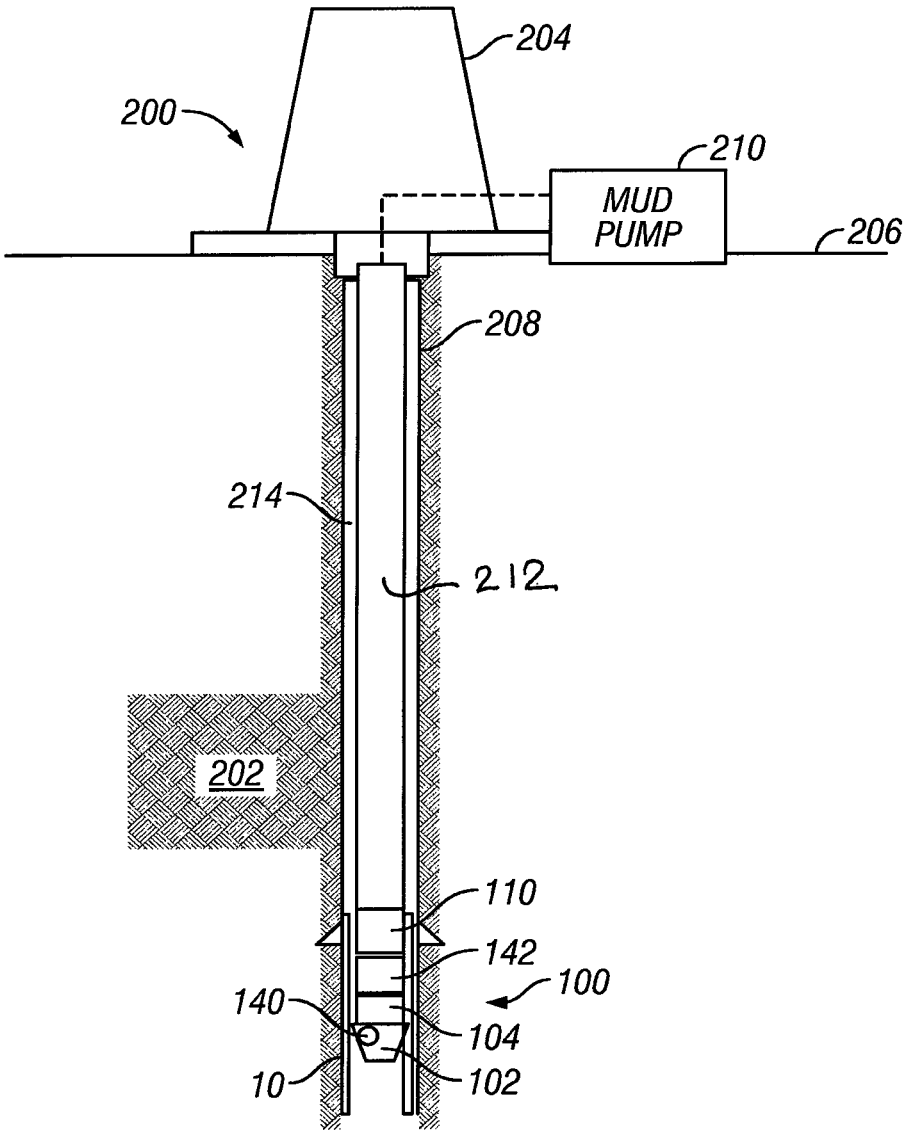
FIG. 2 schematically illustrates a sectional elevation view of a wellbore system utilizing an expansion device made in accordance with the present invention.

Referring now to FIG. 2, there is shown a well construction facility 200 positioned over a subterranean formation 202. While the facility 200 is shown as land-based, it can also be located offshore. The facility 200 can include known equipment and structures such as a derrick 204 at the earth's surface 206, a casing 208, and mud pumps 210. A work string 212 suspended within a well bore 214 is used to convey tooling and equipment into the wellbore 214. The work string 212 can include jointed tubulars, drill pipe, coiled tubing, production tubing, liners, casing and can include telemetry lines or other signal/power transmission mediums that establish one-way or two-way data communication and power transfer from the surface to a tool connected to an end of the work string 212. A suitable telemetry system (not shown) can be known types as mud pulse, electrical signals, acoustic, or other suitable systems. The particular equipment present at the facility 200 and in the wellbore 214, of course, depends on a number of factors, e.g., whether the well is land or offshore, whether the well is being drilled, competed, or worked over, etc.

The expansion device 100 is connected at an end or along the work string 212. The wellbore tool or device 10 requiring expansion can also be carried by the work string 212 or previously positioned in the wellbore 214. In either instance, the operational configuration of the device 10 requires radial or circumferential expansion of one or more sections of the device 10. For instance, the tool 10 can be a liner used to seal a junction of a branch bore (not shown). In other instances, the tool 10 can be a screen positioned in a producing section of the well or a packer used to isolate a section of a well.

Once the expansion device 100 is positioned that a desired depth, the vibration device 104 is energized and the swage body 102 resonates in the axial and/or radial directions. Thereafter, the setting device 110 drives the swage body 102 through the wellbore tubular 10. In one mode of operation, the vibrations continue for the entire length of the swaging operation. In embodiments where the expansion device includes the controller 142, adjustments to the vibration frequency of the swage are made during the swage operation using feedback from the accelerometer. For example, during operation the sensor 140 detects the response of the swage 102 to the vibrations generated by the vibration device 104 and generates signals that correspond to the amplitude of the response of the swage 102. The sensor signals are fed to the controller 142. The controller 142 processes the received sensor signals to determine the amplitude of the response of the swage 102 to the induced vibrations and further processes such data according to the stored instructions (programs) 144. The controller 142 then changes the operating set points of the vibration device 104, which in turn causes the vibration device 104 to vibrate at a correspondingly different frequency. This procedure is repeated to sweep the desired frequency range to determine the optimum or effective operating frequency.

As should be appreciated, the use of resonant vibrations can reduce the amount of force that must be generated to expand a given wellbore device. This can simplify the construction of the setting device and reduce the risk that the wellbore device will be damaged during the expansion process. Further it should be understood that the teachings of the present invention are not limited to only diametrical expansion. Any situation wherein deformation of a wellbore device involves overcoming or compensating for frictional forces can benefit from the present teachings.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. For example, the teachings of the present invention can also be utilized to generate torsional vibrations. It is intended that the following claims be interpreted to embrace all such modifications and changes.

The invention claimed is:

1. A method for deforming a wellbore tubular in a wellbore, comprising:

urging a body into engagement with the wellbore tubular to apply a static force to the wellbore tubular;

connecting an ultrasonic vibration device to the body with a connector;

generating a specified dynamic force by applying a vibration to the body with the vibration device via the connector, wherein the body resonates by diametrically expanding and contracting in response to the vibrations applied by the vibration device, wherein the vibration device includes a transducer stack, and a function generator applying a driving signal to the transducer stack;

oscillating the transducer stack at a fraction of a resonant frequency of the body to cause the body to resonate at a resonant frequency;

selecting a mass of the body and a frequency of the vibration to generate the specified dynamic force; and expanding the wellbore tubular by applying the specified dynamic force and the static force to the wellbore tubular, the specified dynamic force and the static force cooperating to cause a substantially constant relative motion between the body and the wellbore tubular.

2. The method of claim 1 further comprising causing the body to vibrate in an axial direction.

3. The method of claim 1 wherein the urging step includes moving the body through a passage in the wellbore tubular.

4. The method of claim 1 further comprising measuring a vibration of the body with a sensor; and controlling the vibration device in response to the sensor measurements with a controller by detecting a change in the resonant frequency of the body.

5. The method of claim 1, further comprising causing the body to resonate before contacting the wellbore tubular.

6. The method of claim 1, further comprising changing a frequency of the vibration if a change in the resonant frequency of the body is detected.

7. The method of claim 1, further comprising estimating an amplitude of a response of the body to the vibration.

8. The method of claim 1, further comprising:

detecting a response of the body to the vibrations applied by the vibration device via a sensor;

generating sensor signals that correspond to an amplitude of the response of the body;

feeding the sensor signals to a controller;

processing the sensor signals using the controller to determine the amplitude of the response of the body; and causing the vibration device to vibrate at a correspondingly different frequency.

9. The method of claim 1, wherein the body resonates at an ultrasonic frequency.

10. An apparatus for deforming a wellbore tubular in a wellbore, comprising:

a body deforming the wellbore tubular;

a setting tool configured to apply a static force to the body to deform the wellbore tubular; and an ultrasonic vibration device connected to the body by a connector, wherein the vibration device includes a transducer stack, and a function generator applying a driving signal to the transducer stack, the vibration device applying a vibration to the body via the connector at a fraction of a resonant frequency of the body to cause the body to resonate at a resonant frequency, wherein the body resonates by diametrically expanding and contracting in response to the vibration, wherein a mass of the body and a frequency of the vibration are selected to generate a dynamic force for deforming the wellbore tubular, and wherein the setting tool and the vibration device cooperate to cause a substantially constant relative motion between the body and the wellbore tubular.

11. The apparatus of claim 10 wherein the vibration device further causes the body to vibrate in an axial direction.

12. The apparatus of claim 10 wherein the body has a diameter larger than a diameter of a passage through the wellbore tubular.

13. The apparatus of claim 10 further comprising a sensor measuring a vibration of the body; and a controller controlling the vibration device in response to the sensor measurements, the controller including instructions for detecting a change in the resonant frequency of the body.

14. The apparatus of claim 10 wherein the transducer stack includes a plurality of electrically activated elements, magnetostrictive transducers, a jar, or a combination thereof.

15. A system for deforming a wellbore tubular in a wellbore, comprising:

a rig at a surface location;

a work string disposed in the wellbore;

a setting tool configured to generate a static force to deform the wellbore tubular;

a body connected to the work string, the body being shaped to deform the wellbore tubular upon engaging the wellbore tubular; and an ultrasonic vibration device connected to the body by a connector, the vibration device applying a vibration to the body via the connector at a fraction of a resonant frequency of the body to cause the body to resonate at a resonant frequency, wherein the vibration is configured to apply impulsive blows having a non-sustained amplitude, wherein the body resonates and diametrically expands and contracts in response to the vibration, wherein a mass of the body and a frequency of the vibration are selected to generate a dynamic force for deforming the wellbore tubular, and wherein the setting tool and the vibration device cooperate to cause a substantially constant relative motion between the body and the wellbore tubular.

16. The system according to claim 15 wherein the vibration device causes the body to vibrate in one of (i) a radial direction, and (ii) an axial direction.

17. The system according to claim 15 further comprising a sensor measuring a vibration of the body; and a controller controlling the vibration device in response to the sensor measurements; the controller including instructions for detecting a change in the resonant frequency of the body.

* * * * *